US010948855B2

(12) United States Patent
Sugiyama

(10) Patent No.: US 10,948,855 B2
(45) Date of Patent: Mar. 16, 2021

(54) IMAGE FORMING APPARATUS CAPABLE OF PREVENTING A REGULATION MEMBER FROM BEING BROKEN OR SLIPPING OFF WHEN A JAMMED SHEET IS REMOVED FROM A TRANSFER PORTION

(71) Applicant: CANON KABUSHIKI KAISHA, Tokyo (JP)

(72) Inventor: Tadahisa Sugiyama, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/732,939

(22) Filed: Jan. 2, 2020

(65) Prior Publication Data

US 2020/0218182 A1 Jul. 9, 2020

(30) Foreign Application Priority Data

Jan. 8, 2019 (JP) ..... JP2019-001005

(51) Int. Cl.

*G03G 15/00* (2006.01)
*G03G 15/20* (2006.01)
*G03G 21/16* (2006.01)

(52) U.S. Cl.

CPC ..... *G03G 15/2028* (2013.01); *G03G 15/657* (2013.01); *G03G 21/1638* (2013.01)

(58) Field of Classification Search

CPC ..... G03G 15/2028; G03G 15/657; G03G 21/1638

USPC ..... 399/124, 322, 397, 400

See application file for complete search history.

(56) References Cited

U.S. PATENT DOCUMENTS 6,108,514 A * 8/2000 Nakayama et al. . G03G 15/657 399/400
8,306,458 B2 * 11/2012 Takeuchi ..... G03G 21/1633 399/124
8,971,731 B2 * 3/2015 Murakami ..... G03G 15/2028 399/21

FOREIGN PATENT DOCUMENTS

JP 02-190886 A 7/1990
JP 2005-132617 A 5/2005

* cited by examiner

*Primary Examiner* — William J Royer
(74) *Attorney, Agent, or Firm* — Venable LLP

(57) ABSTRACT

An image forming apparatus includes a fixing device arranged downstream of a transfer portion and configured to fix a toner image on a sheet; a regulation member arranged upstream of the fixing device and configured to regulate the sheet; a rotary shaft configured to rotatably support the regulation member; an urging member configured to urge the regulation member so as to bring a tip end portion of the regulation member into contact with the transfer portion at a contact portion; and an openable and closable member provided on a main body to open an opening portion, wherein the tip end portion can be rotated from a side opposite to the rotary shaft to a side of the rotary shaft with respect to a straight line extending from the contact portion and contacting the fixing device.

12 Claims, 4 Drawing Sheets

IMAGE FORMING APPARATUS CAPABLE OF PREVENTING A REGULATION MEMBER FROM BEING BROKEN OR SLIPPING OFF WHEN A JAMMED SHEET IS REMOVED FROM A TRANSFER PORTION

BACKGROUND OF THE INVENTION

Field of the Invention

The present invention relates to an image forming apparatus including a regulation member configured to regulate a conveyance direction of a sheet downstream of a transfer portion configured to transfer a toner image onto the sheet.

Description of the Related Art

Hitherto, in some cases, an electrophotographic image forming apparatus includes a regulation member configured to separate a sheet from a transfer portion, which is configured to transfer an image onto the sheet, in order to prevent the sheet from being wound at the transfer portion. However, when the sheet cannot be separated due to an unexpected factor so that the sheet is wound around a transfer roller, or when sheet jam (hereinafter, referred to as "jam") occurs near the regulation member, the sheet may strongly hit against the regulation member at the time of jam clearance, with the result that the regulation member may slip off or be broken. In Japanese Patent Application Laid-Open No. 2005-132617, the following is disclosed. Specifically, in a method of assembling a regulation member, a predetermined relationship is satisfied between the regulation member and an inner diameter of an urging member configured to urge the rotatable regulation member, thereby regulating a rotatable angle of the regulation member, and preventing the regulation member from slipping off at the time of jam clearance. Further, in Japanese Patent Application Laid-Open No. H02-190886, the following is disclosed. Specifically, there is provided an abutment portion configured to come into abutment against a regulation member so as to prevent the regulation member from being rotated by a predetermined angle or more even when the regulation member is pushed by a jammed sheet bent into a bellows shape. In Japanese Patent Application Laid-Open No. H02-190886, a rotation angle of the regulation member is regulated by the abutment portion, thereby limiting a contact position between the regulation member and the sheet, and preventing breakage of the regulation member.

However, when a user performs jam clearance, there is a fear in that the user pulls the jammed sheet with a force larger than expected. In the configuration described in Japanese Patent Application Laid-Open No. 2005-132617, the regulation member can be prevented from slipping off at the time of jam clearance. However, when the force larger than expected is applied to the regulation member via the sheet, there is a fear in that the regulation member is broken without slipping off. Further, in the configuration described in Japanese Patent Application Laid-Open No. H02-190886, when the contact position between the regulation member and the jammed sheet cannot be limited due to an unexpected event, there is a fear in that a large force is applied to the regulation member at the time of jam clearance due to the limitation on the rotation angle of the regulation member, with the result that the regulation member may be broken.

SUMMARY OF THE INVENTION

In view of the circumstances described above, the present invention provides an image forming apparatus capable of preventing a regulation member from being broken or slipping off due to a force applied to the regulation member when a user pulls a sheet from a transfer portion to perform jam clearance.

According to an embodiment of the present invention, there is provided an image forming apparatus, comprising:

a conveying portion configured to convey a sheet in a conveyance direction;

a transfer portion configured to transfer a toner image onto the sheet conveyed from the conveying portion;

a fixing device, which is arranged downstream of the transfer portion in the conveyance direction, and is configured to fix the toner image on the sheet;

a regulation member, which is arranged upstream of the fixing device in the conveyance direction, and is configured to regulate the sheet so that the sheet on which the toner image has been transferred is conveyed from the transfer portion to the fixing device;

a rotary shaft configured to rotatably support the regulation member;

an urging member configured to urge the regulation member toward the transfer portion so as to bring a tip end portion of the regulation member into contact with the transfer portion at a contact portion;

a main body provided with the fixing device, the regulation member, and the urging member; and an openable and closable member, which is openably and closably provided to the main body, and is configured to open an opening portion formed in the main body so as to open the transfer portion and the fixing device, wherein the regulation member is configured so that the tip end portion of the regulation member can be rotated from a side opposite to the rotary shaft to a side of the rotary shaft with respect to a straight line extending from the contact portion and contacting the fixing device.

Further features of the present invention will become apparent from the following description of exemplary embodiments with reference to the attached drawings.

DESCRIPTION OF THE EMBODIMENTS (Image Forming Apparatus)

Figure 1:
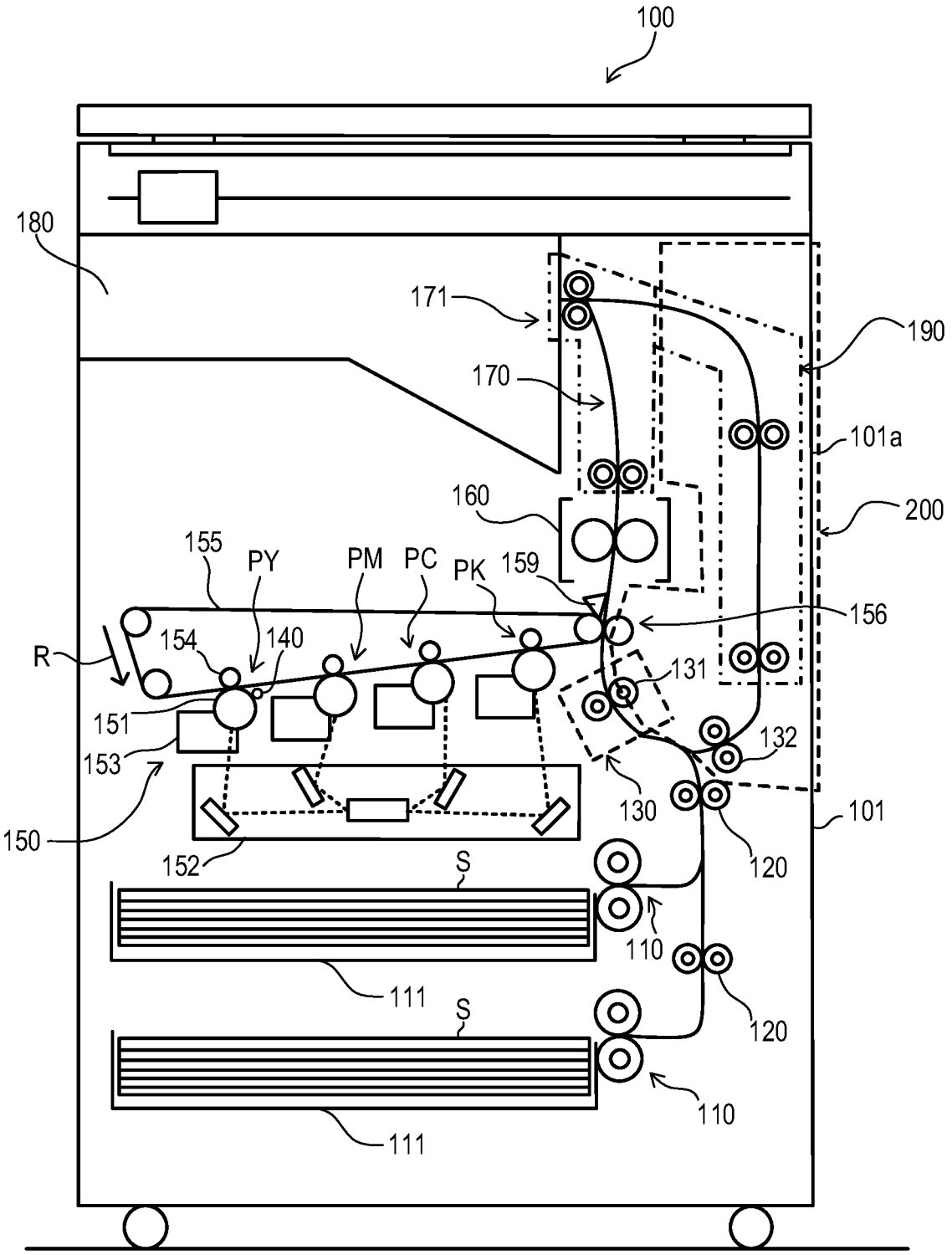
FIG. 1 is a sectional view for illustrating an image forming apparatus.

FIG. 1 is a sectional view for illustrating an image forming apparatus 100. The image forming apparatus 100 includes a transfer portion 156 and a regulation member 159. The transfer portion 156 is configured to transfer a toner image on an intermediate transfer belt 155, which serves as an intermediate transfer member, onto a recording medium (hereinafter, referred to as "sheet") S. The regulation member 159 is arranged downstream of the transfer portion 156 in a conveyance direction of the sheet S, and is configured to regulate the conveyance direction of the sheet S. The regulation member 159 has a function of separating the sheet S from the intermediate transfer belt 155. The image forming apparatus 100 includes an image forming portion 150 configured to form an image on the sheet S. Examples of the sheet S include, in addition to paper such as plain paper and cardboard, sheets made of freely-selected materials, specifically, special paper such as coated paper, a plastic film for an overhead projector, and fabric, and include sheets having freely-selected shapes, specifically, an envelope and an index sheet.

The image forming portion 150 includes four image forming stations PY, PM, PC, and PK. The image forming station PY is configured to form a yellow image with yellow toner. The image forming station PM is configured to form a magenta image with magenta toner. The image forming station PC is configured to form a cyan image with cyan toner. The image forming station PK is configured to form a black image with black toner. The characters Y, M, C, and K added to the reference symbols denote yellow, magenta, cyan, and black, respectively. In the following description, when distinction is not particularly necessary, the characters Y, M, C, and K added to the reference symbols may be omitted. The four image forming stations PY, PM, PC, and PK have the same structure except for developer (toner) colors.

The image forming station P includes a photosensitive drum 151 serving as a rotating photosensitive member. A charging roller 140, a laser scanner unit 152, a developing device 153, and a primary transfer device 154 are provided around the photosensitive drum 151. The charging roller 140 is configured to uniformly charge a surface of the photosensitive drum 151. The laser scanner unit 152 serving as an exposure device is configured to emit laser light, which is modulated by a signal based on image information processed by a controller (not shown), to the surface of the photosensitive drum 151 having been uniformly charged, thereby forming an electrostatic latent image. The developing device 153 is configured to develop the electrostatic latent image on the photosensitive drum 151 with toner, and form a toner image on the surface of the photosensitive drum 151. The primary transfer device 154 is configured to bring the intermediate transfer belt 155 into contact with the photosensitive drum 151 with a predetermined pressure force, apply electrostatic load bias, and transfer the toner image on the photosensitive drum 151 onto the intermediate transfer belt 155. The intermediate transfer belt 155 is rotated in a direction indicated by the arrow R in FIG. 1. The toner images formed by the four image forming stations PY, PM, PC, and PK are sequentially superimposed on the intermediate transfer belt 155. The toner image formed on the intermediate transfer belt 155 is conveyed to the transfer portion 156 serving as a secondary transfer portion.

Cassettes 111 each configured to accommodate a plurality of sheets S are provided in a lower portion of the image forming apparatus 100. The plurality of sheets S stacked on the respective cassettes 111 are separated one by one and fed by a feeding portion 110. The fed sheet S is conveyed by drawing rollers 120 to a sheet skew feed correcting device 130 arranged on the downstream side in the conveyance direction of the sheet S (hereinafter, simply referred to as "downstream side"). The sheet skew feed correcting device 130 includes a registration roller pair 131. A leading edge of the sheet S is brought into abutment against a nip of the stopped registration roller pair 131, thereby correcting skew feed of the sheet S. The registration roller pair 131 starts rotation to convey the sheet S to the transfer portion 156 so that a leading edge of the toner image on the intermediate transfer belt 155 and the leading edge of the sheet S are matched with each other at the transfer portion 156. The sheet skew feed correcting device 130 is a conveying portion configured to convey the sheet S to the transfer portion 156.

The transfer portion 156 transfers the toner image on the intermediate transfer belt 155 onto the sheet S. The sheet S having the toner image transferred thereonto is conveyed to a fixing device 160. The fixing device 160 heats and pressurizes the sheet S to melt the toner, thereby fixing the toner image on the sheet S. In this manner, an image is formed on the sheet S. The sheet S having the image formed thereon is caused to pass through a post-fixing conveying portion 170, and is stacked in an aligned manner by a delivery device 171 on a delivery tray 180 provided in a main body of the image forming apparatus 100.

In a case of double-sided printing of forming images on both surfaces of the sheet S, the delivery device 171 allows the leading edge of the sheet S to protrude above the delivery tray 180, and then reverses the sheet S to switch the direction of the sheet S backward, thereby conveying the sheet S to a reverse conveying device 190. The sheet S conveyed to the reverse conveying device 190 is conveyed by the reverse conveying device 190 to before-registration conveyance rollers 132, and then is conveyed to the sheet skew feed correcting device 130 arranged on the downstream side. After skew feed of the sheet S is corrected by the sheet skew feed correcting device 130, the sheet S is conveyed to the transfer portion 156, and the toner image is transferred onto a second surface (back surface) of the sheet S. The sheet S is conveyed to the fixing device 160, and the toner image is fixed by the fixing device 160 on the second surface. The sheet S having the images formed on both surfaces thereof is caused to pass through the post-fixing conveying portion 170, and is delivered by the delivery device 171 onto the delivery tray 180. In order to open an inside of the image forming apparatus 100 so as to enable access for part replacement and jam clearance, a door (cover) 200 serving as an openable and closable member is openably and closably provided on a main body 101 of the image forming apparatus 100. By opening the door 200, a user can pull out the sheet S jammed in the transfer portion 156 through an opening portion 101*a* formed in the main body 101.

(Regulation Member)

Figure 2A:
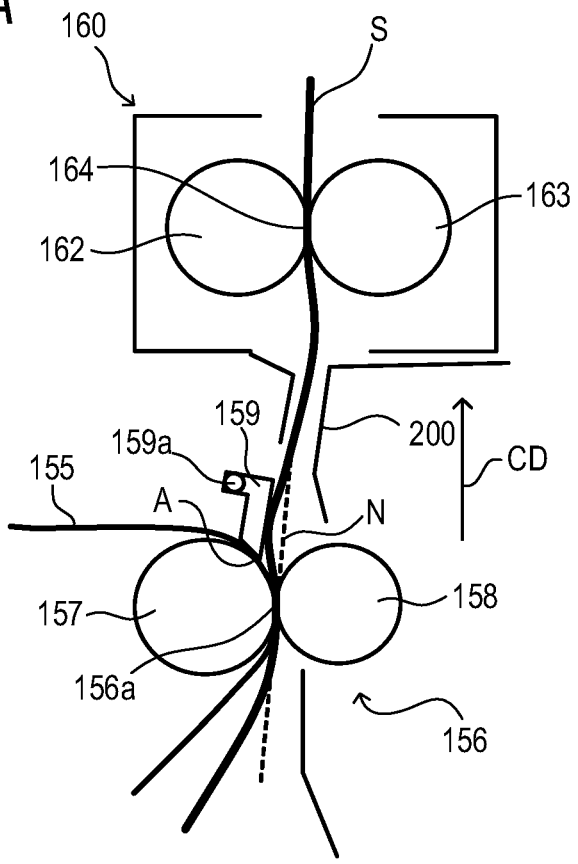
FIG. 2A and FIG. 2B are sectional views for illustrating a transfer portion and a fixing device.
Figure 2B:
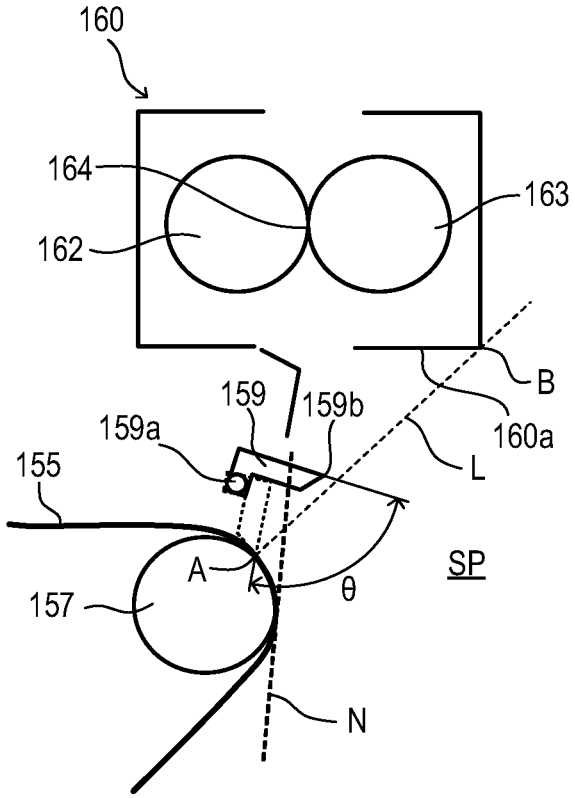

Next, with reference to FIG. 2A, FIG. 2B, FIG. 3A, and FIG. 3B, the regulation member 159 is described. The regulation member 159 is arranged in the transfer portion 156, and is configured to separate the sheet S from the intermediate transfer belt 155. FIG. 2A and FIG. 2B are sectional views for illustrating the transfer portion 156 and the fixing device 160. FIG. 2A is a view for illustrating the sheet S conveyed through the transfer portion 156 and the fixing device 160 under a state in which the door 200 is closed. FIG. 2B is a view for illustrating a state in which the door 200 is opened for jam clearance. An opposing roller 158 is arranged on the door 200 so as to be rotatable. The fixing device 160 includes a heating rotary member 162 and a pressure rotary member 163. The pressure rotary member 163 is held in press contact with the heating rotary member 162 to form a nip 164 between the heating rotary member 162 and the pressure rotary member 163. A transfer roller 157 and the opposing roller 158 are provided to the main body 101 of the image forming apparatus 100. The regulation member 159 is arranged downstream of the transfer portion 156 and upstream of the fixing device 160 in a conveyance direction CD, and is configured to regulate the conveyance direction CD of the sheet S so that the sheet S having the toner image transferred thereonto is conveyed from the transfer portion 156 to the fixing device 160. As illustrated in FIG. 2A, the regulation member 159 is arranged so as to be brought into abutment against the transfer roller 157 through intermediation of the intermediate transfer belt 155 at a contact portion A. A rotary shaft 159*a* is configured to rotatably support the regulation member 159. The regulation member 159 is configured to be rotatable about the rotary shaft 159*a* in the same direction as the conveyance direction CD of the sheet S. The regulation member 159 is rotatable in a rotation plane 165 (FIG. 3B) perpendicular to the rotary shaft 159*a*.

Figure 3A:
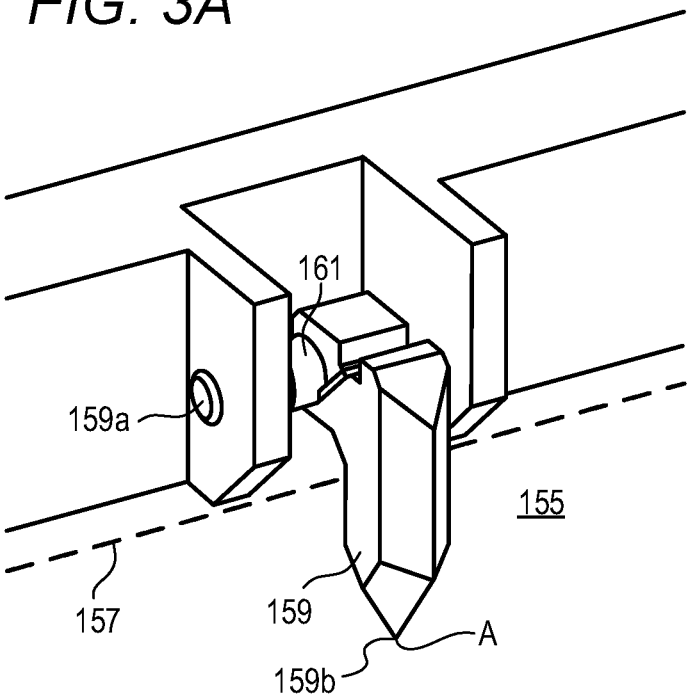
FIG. 3A and FIG. 3B are views for illustrating a regulation member.
Figure 3B:
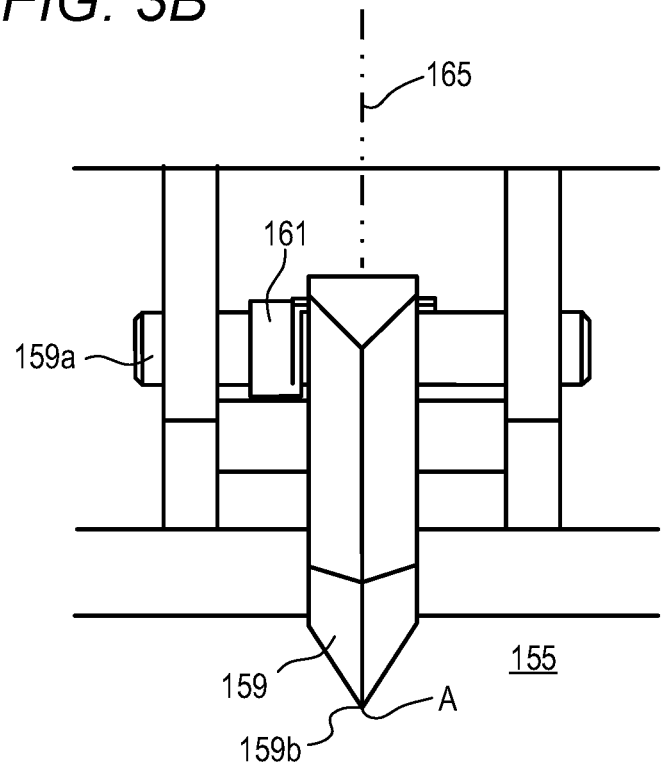

FIG. 3A and FIG. 3B are views for illustrating the regulation member 159. FIG. 3A is a perspective view for illustrating the regulation member 159. FIG. 3B is a view for illustrating the regulation member 159 seen from a right side of the image forming apparatus 100 illustrated in FIG. 1. An urging member 161 is provided on the main body 101 of the image forming apparatus 100, and is configured to urge the regulation member 159 toward the transfer roller 157. Examples of the urging member 161 include a spring such as a torsion spring or a power spring, and an elastic member such as rubber. As illustrated in FIG. 3A and FIG. 3B, the regulation member 159 is urged by the urging member 161 toward the transfer roller 157, and is brought into press contact with the transfer roller 157. The regulation member 159 is brought into abutment against the transfer roller 157 through intermediation of the intermediate transfer belt 155 at the contact portion A. As illustrated in FIG. 3A and FIG. 3B, a tip end portion 159*b* of the regulation member 159 is formed into a sharp shape in order to reduce a contact region between the transfer roller 157 and the regulation member 159. The regulation member 159 is substantially brought into point contact with the intermediate transfer belt 155 at the contact portion A. The contact portion A is arranged on a downstream side of a transfer roller nip portion 156*a* between the transfer roller 157 and the opposing roller 158 of the transfer portion 156 in the conveyance direction CD of the sheet S. Further, the contact portion A is arranged on the main body 101 side (on a side opposite to the opening portion 101*a* of the main body 101 in which the door 200 is provided) with respect to a nip line N of the transfer roller nip portion 156*a*. Further, the contact portion A is positioned substantially at a center of a sheet conveyance path in a width direction orthogonal to the conveyance direction CD of the sheet S.

After the toner image is transferred onto the sheet S at the transfer roller nip portion 156*a*, an adhesion force is generated between the sheet S and the transfer roller 157 by, for example, static electricity. Due to the adhesion force, the sheet S is liable to remain adhered to the intermediate transfer belt 155 on the transfer roller 157 even after passing through the transfer roller nip portion 156*a*. When the sheet S is conveyed while remaining adhered to the intermediate transfer belt 155, there is a fear in that the sheet S is jammed without being conveyed to the fixing device 160. Therefore, the regulation member 159 is brought into press contact with the intermediate transfer belt 155 on the transfer roller 157 at the contact portion A so as to regulate the conveyance direction CD of the sheet S. In this manner, the sheet S is separated from the transfer roller 157, and thus can be conveyed to the fixing device 160 provided on the downstream side of the transfer portion 156.

The transfer roller 157 of the transfer portion 156 is arranged on the main body 101 of the image forming apparatus 100, whereas the opposing roller 158, which is to be brought into abutment against the transfer roller 157, is arranged on the door 200 that is openable and closable with respect to the main body 101. The opposing roller 158 is held in abutment against the transfer roller 157 during operation of the image forming apparatus 100. However, when the door 200 is opened for jam clearance, the opposing roller 158 is separated from the transfer roller 157 so that a space SP near the transfer portion 156 and the fixing device 160 is opened. Meanwhile, the fixing device 160 is fixed to the main body 101. The regulation member 159 is configured so that, when the door 200 is opened for jam clearance, as illustrated in FIG. 2B, the tip end portion 159*b* of the regulation member 159 is rotatable by such an angle θ as to overpass a connection line L connecting the contact portion A and a point B of an upstream portion 160*a* of the fixing device 160 farthest from the contact portion A. That is, the regulation member 159 is configured so that the tip end portion 159*b* is rotated from a side opposite to the rotary shaft 159*a* to the rotary shaft 159*a* side with respect to the connection line L being a straight line. In the rotation plane 165 in which the regulation member 159 is rotated, the tip end portion 159*b* is rotatable to a nip side of the fixing device 160 with respect to the connection line L being the straight line that extends from the contact portion A toward the opening portion 101*a* and reaches the fixing device 160. In this embodiment, the upstream portion 160*a* of the fixing device 160 is a surface of the fixing device 160 closest to the transfer portion 156. In a vertical section of the image forming apparatus 100 that is perpendicular to the width direction of the sheet S to be conveyed and passes through the regulation member 159, the point B is farthest from the contact portion A on the surface of the fixing device 160 closest to the transfer portion 156. The point B is closest to the opening portion 101*a* of the main body 101. When a bottom surface of the fixing device 160 is not a flat surface, the point B may be defined as a point at which the straight line, which extends from the contact portion A toward the opening portion 101*a* and pivots about the contact portion A to the upstream side in the conveyance direction CD, reaches the fixing device 160.

Figure 4A:
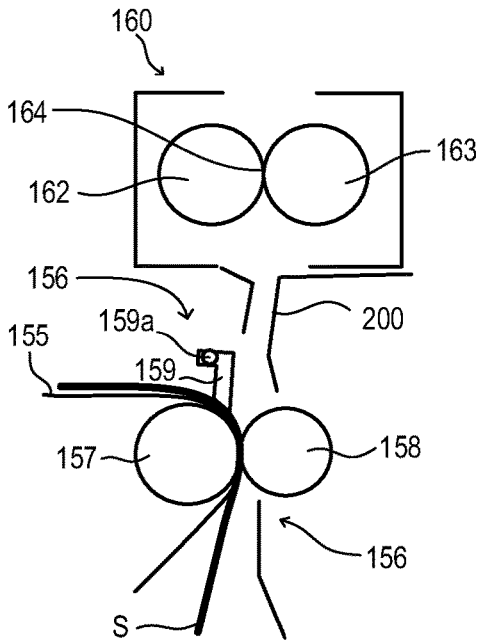
FIG. 4A, FIG. 4B and FIG. 4C are explanatory views for illustrating jam clearance.
Figure 4B:
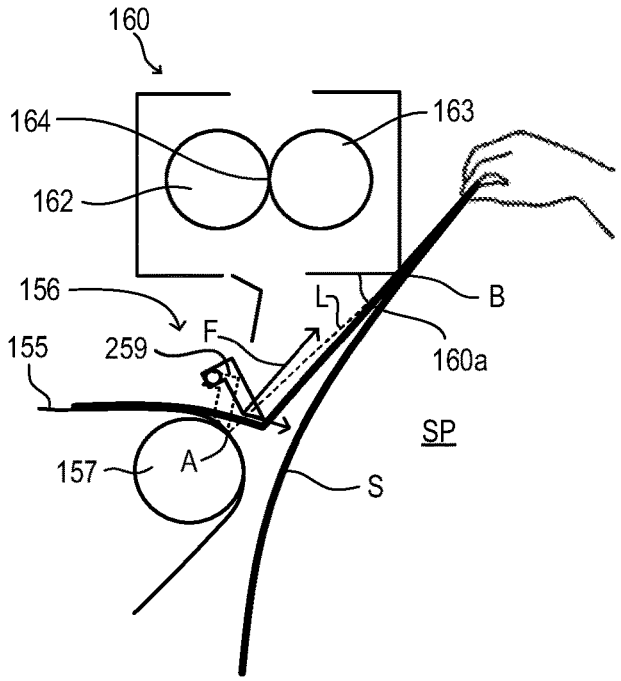
Figure 4C:
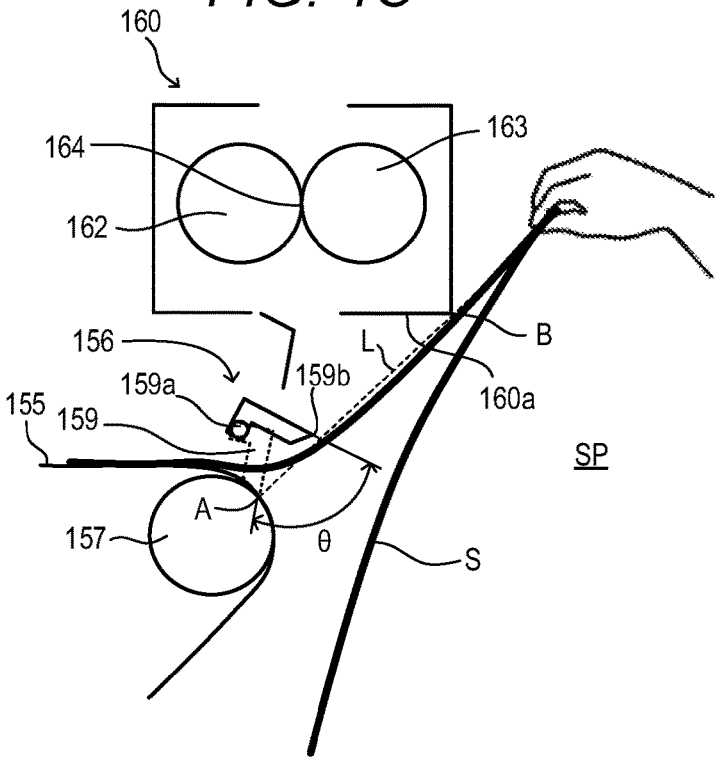

When jam occurs near the transfer portion 156, a user opens the door 200, and performs jam clearance of removing the jammed sheet S in the opened space SP. FIG. 4A, FIG. 4B, and FIG. 4C are explanatory views for illustrating jam clearance. When the sheet S enters a lower side of the regulation member 159 without being separated from the intermediate transfer belt 155 on the transfer roller 157, jam occurs as illustrated in FIG. 4A. A user opens the door 200 to open the space SP near the transfer portion 156. At this time, there is a fear in that a large force is applied to the regulation member 159 depending on a direction of removing the jammed sheet S by the user. FIG. 4B is a view for illustrating, as a reference example, a regulation member 259 that is not rotatable or has a rotation angle limited within a small range. When a user performs jam clearance by pulling the sheet S in a direction of exceeding the limited angle of the regulation member 259, a force in a direction indicated by the arrow F, which is parallel to the direction of pulling the sheet S, is applied through intermediation of the sheet S to the regulation member 259 that is not rotatable by the limited angle or more. As a result, there is a risk in that the sheet S is torn to cause degradation in jam recovery, or the regulation member 259 is broken or slips off.

FIG. 4C is a view for illustrating the regulation member 159 in this embodiment configured so that the tip end portion 159*b* of the regulation member 159 is rotatable by such the angle A or more as to overpass the connection line L. When a user pulls the sheet S to perform jam clearance, the tip end portion 159*b* of the regulation member 159 is rotated to the upstream side in the conveyance direction CD. With regard to a direction of pulling the sheet S in the space SP that is near the transfer portion 156 and is opened at the time of jam clearance, when the sheet S is pulled in a direction on the connection line L, the rotation angle of the regulation member 159 is maximum. According to this embodiment, as illustrated in FIG. 4C, the tip end portion 159*b* of the regulation member 159 is rotated by such the angle A or more as to overpass the connection line L. Thus, even when a user pulls the sheet S at any angle in the space SP opened at the time of jam clearance, rotation of the regulation member 159 is not limited. Even when the sheet S is pulled at any angle in the opened space SP, the regulation member 159 is rotated within a rotatable angle range. Therefore, a force larger than expected is not applied to the regulation member 159, thereby being capable of preventing the regulation member 159 from being broken or slipping off.

As described above, according to the present invention, the regulation member 159 can be prevented from being broken or slipping off due to a force applied to the regulation member 159 when a user pulls the sheet S from the transfer portion 156 to perform jam clearance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-001005, filed Jan. 8, 2019, which is hereby incorporated by reference herein in its entirety.

What is claimed is:

1. An image forming apparatus, comprising:

a conveying portion configured to convey a sheet in a conveyance direction;

a transfer portion configured to transfer a toner image onto the sheet conveyed from the conveying portion;

a fixing device, which is arranged downstream of the transfer portion in the conveyance direction, and is configured to fix the toner image on the sheet;

a regulation member, which is arranged upstream of the fixing device with respect to the conveyance direction, and is configured to regulate the sheet so that the sheet on which the toner image has been transferred is conveyed from the transfer portion to the fixing device;

a rotary shaft configured to rotatably support the regulation member;

an urging member configured to urge the regulation member toward the transfer portion so as to bring a tip end portion of the regulation member into contact with the transfer portion at a contact portion;

a main body provided with the fixing device, the regulation member, and the urging member; and an openable and closable member, which is openably and closably provided on the main body, and is configured to open an opening portion formed in the main body so as to open access to the transfer portion and the fixing device, wherein the regulation member is configured so that the tip end portion of the regulation member can be rotated from a side opposite to the rotary shaft to a side of the rotary shaft with respect to a straight line extending from the contact portion and contacting the fixing device.

2. The image forming apparatus according to claim 1, wherein, in a rotation plane in which the regulation member is rotated, the tip end portion is rotatable to a nip side of the fixing device with respect to the straight line extending from the contact portion, at which the tip end portion is brought into contact with the transfer portion, and contacting the fixing device.

3. The image forming apparatus according to claim 1, wherein, in a cross-section of the image forming apparatus that is perpendicular to a width direction of the sheet conveyed from the conveying portion and passes through the regulation member, the straight line connects the contact portion and a point farthest from the contact portion on a surface of the fixing device closest to the transfer portion.

4. The image forming apparatus according to claim 3, wherein the point is closest to the opening portion in the cross-section.

5. The image forming apparatus according to claim 1, wherein the transfer portion includes a transfer roller and an opposing roller, and wherein the opposing roller is separated from the transfer roller when the openable and closable member is opened.

6. The image forming apparatus according to claim 1, further comprising:

a photosensitive member;

an image forming portion configured to form the toner image on a surface of the photosensitive member; and an intermediate transfer member, onto which the toner image formed on the surface of the photosensitive member is transferred, and from which the toner image is transferred onto the sheet by the transfer portion, wherein the tip end portion of the regulation member is brought into contact with the transfer portion through the intermediate transfer member.

7. The image forming apparatus according to claim 1, wherein the straight line extends from the contact portion toward the opening portion.

8. An image forming apparatus, comprising:

a conveying portion configured to convey a sheet in a conveyance direction;

a transfer belt configured to bear a toner image to be transferred onto the sheet conveyed by the conveying portion;

a fixing device arranged above the transfer belt and configured to fix the toner image on the sheet;

a regulation member, which is configured to regulate the sheet so that the sheet on which the toner image has been transferred is conveyed to the fixing device;

a rotary shaft configured to rotatably support the regulation member about an axis line extending along a width direction of the sheet perpendicular to the conveyance direction;

an urging member configured to urge the regulation member toward the transfer belt so as to bring a tip end portion of the regulation member into contact with the transfer belt at a contact portion;

a main body provided with the fixing device, the transfer belt, the regulation member, and the urging member; and a cover, which is movably provided on the main body, and is configured to move so as to open access to at least a part of the transfer belt and at least a part of the fixing device, wherein the regulation member is configured so that the tip end portion of the regulation member can be rotated from a side opposite to the rotary shaft to a side of the rotary shaft with respect to a straight line, wherein, in a cross-section of the image forming apparatus that is perpendicular to the width direction of the sheet and passes through the regulation member, the straight line passes the contact portion and an end of the fixing device in a horizontal direction that is closest to the cover in the horizontal direction on a lower surface of the fixing device.

9. The image forming apparatus according to claim 8, wherein the rotary shaft is arranged above the contact portion.

10. The image forming apparatus according to claim 8, further comprising a roller which nips the sheet with the transfer belt.

11. The image forming apparatus according to claim 10, wherein the roller is provided on the cover.

12. The image forming apparatus according to claim 8, further comprising:

a photosensitive member; and an image forming portion configured to form the toner image on a surface of the photosensitive member, wherein the toner image formed on the surface of the photosensitive member is transferred onto the transfer belt.

* * * * *